US012264841B2

(12) United States Patent
Naber

(10) Patent No.: US 12,264,841 B2
(45) Date of Patent: Apr. 1, 2025

(54) SILENCER FOR MOUNTING IN AN AIR DUCT

(71) Applicant: Naber Holding GmbH & Co., Nordhorn (DE)

(72) Inventor: Hans-Joachim Naber, Nordhorn (DE)

(73) Assignee: Naber Holding GmbH & Co., Nordhorn (DE)

( * ) Notice: Subject to any disclaimer, the term of this patent is extended or adjusted under 35 U.S.C. 154(b) by 248 days.

(21) Appl. No.: 17/746,214

(22) Filed: May 17, 2022

(65) Prior Publication Data

US 2022/0373224 A1 Nov. 24, 2022

(30) Foreign Application Priority Data

May 21, 2021 (DE) ..... 10 2021 113 240.1

(51) Int. Cl.
*F24F 13/24* (2006.01)
*F24F 13/02* (2006.01)

(52) U.S. Cl.
CPC ..... *F24F 13/24* (2013.01); *F24F 13/0254* (2013.01); *F24F 2013/242* (2013.01)

(58) Field of Classification Search
CPC ... F24F 13/24; F24F 13/0254; F24F 2013/242
See application file for complete search history.

(56) References Cited

U.S. PATENT DOCUMENTS

| | | | | |
|---|---|---|---|---|
| 4,068,736 | A * | 1/1978 | Dean | F01N 1/00 181/252 |
| 4,330,047 | A * | 5/1982 | Ruspa | F24F 13/08 454/906 |
| 8,307,947 | B2 * | 11/2012 | Bussow | F16L 55/0331 181/212 |
| 8,579,074 | B2 * | 11/2013 | Kosaka | F02C 7/045 181/224 |
| 9,890,713 | B2 * | 2/2018 | Zhang | B64D 29/00 |
| 10,458,589 | B2 * | 10/2019 | Hill | F24F 13/24 |
| 10,508,573 | B2 * | 12/2019 | Pedrini | F01N 1/083 |
| 10,722,990 | B2 * | 7/2020 | Parmeshwar | B23P 15/04 |
| 11,604,007 | B2 * | 3/2023 | Mouratidis | G10K 11/161 |
| 2003/0192737 | A1 * | 10/2003 | Han | F28F 9/0263 181/224 |
| 2006/0144638 | A1 * | 7/2006 | Radatus | F24F 13/02 181/224 |
| 2011/0061968 | A1 * | 3/2011 | Helenius | F24F 13/24 219/383 |

(Continued)

FOREIGN PATENT DOCUMENTS

| | | | |
|---|---|---|---|
| CN | 212029862 | U | 11/2020 |
| DE | 3943078 | A1 | 7/1991 |

(Continued)

*Primary Examiner* — Forrest M Phillips
(74) *Attorney, Agent, or Firm* — Harness, Dickey & Pierce, P.L.C.

(57) ABSTRACT

A silencer for installation in an air duct, in particular in a flat duct, having at least one sound-absorbing damping element extending essentially in a longitudinal direction (X), and having at least one holding device which accommodates the damping element at least in sections and has a fastening device for fixing the silencer in the air duct. An assembly comprising an air duct and such a silencer is further described.

18 Claims, 4 Drawing Sheets

(56) References Cited

U.S. PATENT DOCUMENTS

| | | | | |
|---|---|---|---|---|
| 2018/0291781 | A1* | 10/2018 | Pedrini | F01N 1/10 |
| 2022/0373218 | A1* | 11/2022 | Naber | F24F 13/02 |

FOREIGN PATENT DOCUMENTS

| | | | |
|---|---|---|---|
| DE | 10126475 | A1 | 3/2003 |
| EP | 0495763 | B1 | 3/1995 |
| EP | 2252836 | B1 | 11/2010 |
| JP | 2020-026950 | A | 2/2020 |
| KR | 20100134274 | A | 12/2010 |
| KR | 20210037193 | A | 4/2021 |
| SU | 1321857 | A1 | 7/1987 |

* cited by examiner

SILENCER FOR MOUNTING IN AN AIR DUCT

CROSS-REFERENCE TO RELATED APPLICATIONS

This application claims the benefit and priority of German Patent Application No. 10 2021 113 240.1 filed May 21, 2021, the disclosure of which is hereby incorporated by reference herein in its entirety.

FIELD

The invention relates to a silencer for mounting in an air duct, in particular in a flat duct, with at least one sound-absorbing damping element extending essentially in a longitudinal direction of the air duct, and with at least one holding device which receives the damping element at least in sections and has a fastening device for fixing the silencer in the air duct. The invention further relates to an assembly comprising an air duct and a silencer.

BACKGROUND

DE 101 26 475 A1 discloses a silencer for operation in an air duct of a room zone treatment unit, which is used to determine the volume flow passing through the duct. However, no structural details are disclosed by means of which the silencer is to be mounted in an air duct.

SUMMARY

It is therefore an aspect of the present invention to provide a silencer for an air duct which is easy to install and can be variably adapted to different installation situations.

Accordingly, a silencer is proposed for installation in an air duct, in particular in a flat duct, with at least one sound-absorbing damping element extending essentially in a longitudinal direction, and with at least one holding device which receives the damping element at least in sections and has a fastening device for fixing the silencer in the air duct.

One advantage of the silencer according to the invention is that it can be variably adapted to different spatial conditions. By means of the holding devices provided only locally, for example on the end face, the silencer can be adjusted to almost any desired length and thus a corresponding damping element or several parallel damping elements of suitable length can be installed in each case.

Another advantage is that a standardized connection between the silencer and the air duct makes it particularly easy to install the silencer at almost any point in the air duct without the need for additional fasteners and, if necessary, to reposition it easily at a later date.

The silencer can in particular be a splitter silencer. The sound-absorbing damping element can be an damper mat, for example. The silencer can be designed as a multiplex silencer. It may be provided that the silencer or the at least one damping element has different mat materials. The at least one damping element can in particular be fixed between two end-mounted holding devices. The fastening device can be designed in such a way that the silencer can be inserted longitudinally into an air duct provided. The fastening device can be designed in such a way that the silencer can only be moved in the longitudinal direction of the air duct. Furthermore, the fastening device can be preloaded in the installed state, so that a predetermined force threshold must be overcome in order to displace the silencer in the longitudinal direction. It may be provided that a portion of the damping element is not surrounded or received by the at least one holding device. The piece protruding from the damping element receptacle of the at least one holding device can thus be mounted in an exposed position in the air duct.

It can be provided that the silencer has at least two damping elements, which consist of different sound-absorbing materials, which are set up to damp sound in different frequency ranges. Due to the fact that sound is mostly emitted in a very wide frequency range, fans for example move in a range up to 1000 Hz, but individual materials are not able to sufficiently cover the entire relevant frequency range, it is advantageous to use at least two different damping materials. In particular, the use of foamed materials is advantageous. It is conceivable that at least one of the mat materials comprises a melamine resin foam. It may further be envisaged that polyurethane, polyether, polyester or duromer acoustic foam is used as a further foamed insulating material. The use of two or more materials in the multiplex silencer results in significantly improved sound insulation properties over the entire relevant frequency band, so that the silencer is particularly suitable for non-industrial applications in which increasing importance is attached to comfort, in this case in the sense of low noise emissions.

It may be provided that the holding device has at least one, in particular spherical or lenticular, thickening arranged on its outer circumference for generating a defined clamping force between the silencer and the air duct. It may be provided that the fastening device is not designed as part of the air duct, but as an element of the silencer. In this embodiment, the thickening leads to a defined and predeterminable clamping force between the holding device and the air duct when the silencer is inserted into the air duct.

It may be provided that the fastening device has at least two undercut latching portions projecting in a transverse direction of the silencer. In particular, the fastening device can be arranged centrally on an outer side of the holding device. It may be provided that the fastening device is arranged on an upper and/or lower side of the holding device. It may be provided that the latching portions are introduced as undercut L-shaped grooves in the outer contour of the holding device.

Furthermore, the undercut latching portions may be part of at least one guide rail arranged longitudinally on the outer periphery of the holding device. The at least one guide rail may be recessed in the outer contour of the holding device. In particular, the guide rail may be formed as undercut L-shaped grooves extending in the longitudinal direction.

It may be provided that the holding device has two half-shells which are detachably connected to one another, in particular in a height direction of the silencer, and between which the damping element is received and fixed at least in sections. The half shells can have a parting plane lying in the transverse direction of the silencer. Furthermore, the half-shells can be designed as identical parts. A detachable connecting device may be formed on the opposing parting planes. The connecting device may be a latching device. The elements arranged facing one another on the half-shells can be designed to be aligned with one another, in particular in the parting plane.

It may be provided that the outer contour of the interconnected half-shells corresponds to the flow cross-section of the air duct. This means that the outer contour of the holding device can rest against the inner contour of the air duct when the silencer is mounted in the air duct. This allows the interconnected half-shells to have an annular outer geometry.

It may also be provided that the half shells enclose at least one air passage aligned in the longitudinal direction. The geometry of the air passage can correspond to the inner contour of the assembled half shells. It may further be provided that the half-shells enclose a plurality of longitudinally aligned air passages. Each air outlet can open into an air passage formed by two parallel, laterally adjacent damping elements.

It may also be provided that at least one web is formed between the interconnected half-shells, which web traverses the flow cross-section perpendicularly to the longitudinal direction and has an open damping element receptacle facing the damping element in the longitudinal direction, in which receptacle the damping element is received at the end face.

In particular, a plurality of parallel webs, especially three webs, can be provided for each holding device. One of the webs can be arranged centrally as seen in the transverse direction and two webs can be arranged on the outer sides of the holding device. This allows the central web to divide two air diffusers centrally. The outer webs each delimit the air inlet adjacent thereto with an air guide surface located on the inner side of the holding device. In contrast, the outer sides of the outer webs are bounded by the outer contour of the holding device. The plurality of webs is connected by substantially transversely extending half-shell portions bounding the air inlets. The damping element retainer may be formed by a recess extending longitudinally into the web. This allows a face section of the damping element to be inserted into the damping element receptacle and anchored therein. In the parting plane of the half-shells, the webs of the lower and upper parts can each have surfaces aligned to face one another. A releasable connecting device for joining the half shells can be arranged on each of the surfaces.

It may further be provided that the damping element extends through the flow cross-section in the direction perpendicular to the longitudinal direction corresponding to the web. The damping element receptacle may extend in the height direction from the bottom to the top of the holding device. Accordingly, an damping element received in the holding device may correspond to the height of the web. In the case of a flat channel, the damping element may extend from a bottom to a top of the channel.

It may further be provided that the web is arranged in the retainer such that it centrally divides the air passage. It may also be provided that a holding means is provided in the damping element holder for holding the damping element. This allows uniform air passages to be formed to the left and right of the web in the transverse direction.

It may also be provided that the retaining means comprises retaining prongs aligned transversely to the longitudinal direction, onto which the damping element is slipped. The retaining prongs can be aligned in particular parallel to the joining direction of the half shells. The retaining prongs can be aligned in the height direction of the silencer.

It may further be provided that the damping element holder comprises air guiding surfaces surrounding the damping element in longitudinal direction, which shield the damping element laterally from the at least one air passage. It may be provided that the air guiding surfaces extend from the bottom to the top of the holding device.

It may also be provided that the air guide surfaces meet on the side of the web facing away from the damping element, tapering the web in the longitudinal direction. The resulting tapered front side of the web has a favorable effect on the air flow entering the holding device. The webs arranged on the outer sides can each have an air guide surface facing the inner side of the holding device. This can be bent away from the outer web on the side facing away from the respective damping element holder, tapering in the longitudinal direction towards the outer contour of the holding device.

It can also be provided that the holding device has a plurality of webs spaced parallel to one another, in which a corresponding plurality of damping elements spaced parallel to one another are accommodated. For example, the holding device can have three webs, in each of whose damping element receptacles an damping element can be accommodated. The accommodated damping elements may have a substantially cuboidal geometry. The damping elements located on the outer sides can have a laterally recessed outlet region in the region of the at least one holding device in order to improve the air flow.

It can also be provided that the opposite end faces of the at least one damping element are held by two opposite holding devices, the damping element receptacles of the holding devices being aligned to face one another. The at least one damping element can thus be fixed between two opposite holding devices. Between the holding devices, the silencer can have a section in which the damping elements run freely unrestrained. The air thus flows into the silencer through the air passages of one of the holding devices and is then guided through ducts bounded laterally by two damping elements in each case. On the opposite side, the air flows out of the silencer again through corresponding air inlets of the second holding device.

It may further be provided that the air duct comprises a fastening means complementary to the fastening means of the silencer. For example, the air duct may extend substantially in a longitudinal direction, with a duct wall enclosing a flow cross-section, which has a fastening device on its inner side for fastening the silencer receivable in the air duct.

The fastening device of the air duct can have at least one linear rail extending at least in sections in the longitudinal direction of the duct. In particular, the linear rail can be arranged centrally on the duct wall comprising it. The linear rail can extend over the entire length of the duct.

The fastening device of the air duct can have at least two undercut latching portions, whereby the silencer can be pushed onto the fastening device in the longitudinal direction of the duct. For example, the at least one linear rail can have a longitudinal groove in which the two latching portions are designed to face each other in an undercut manner. Alternatively, the at least one linear rail can have two latching portions facing away from each other in the transverse direction on its outer sides.

The fastening device can comprise two parallel linear rails, each of which has an undercut latching portion. For simplified threading of the silencer, the two linear rails can have a widened section at the ends of the channel piece lying in the longitudinal direction or can be slightly spaced apart. In a corresponding manner, the latching portions can also be widened at the widened ends.

The at least one linear rail of the air duct can have a first section extending essentially perpendicularly away from the duct wall and an adjoining second section extending essentially parallel to the duct wall. In this regard, the undercut latching portions may face one another. Alternatively, the undercut latching portions may point away from each other.

DRAWINGS

Further features, advantages and characteristics of the invention can be seen in the following description of preferred embodiments of the invention with reference to the accompanying drawings, in which show:

DETAILED DESCRIPTION

Figure 1:
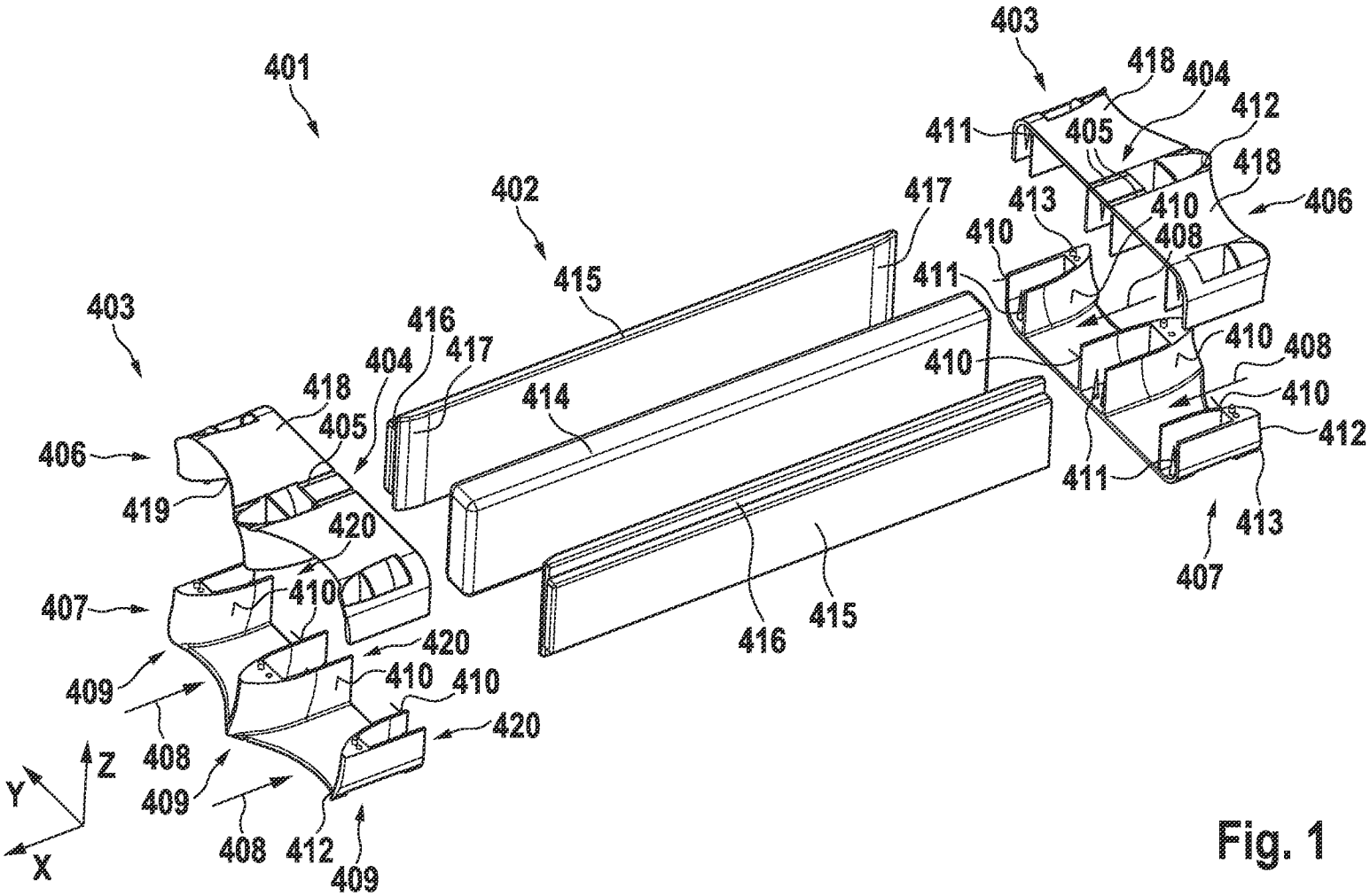
FIG. 1 is a perspective exploded view of an embodiment of the silencer according to the invention.
Figure 2:
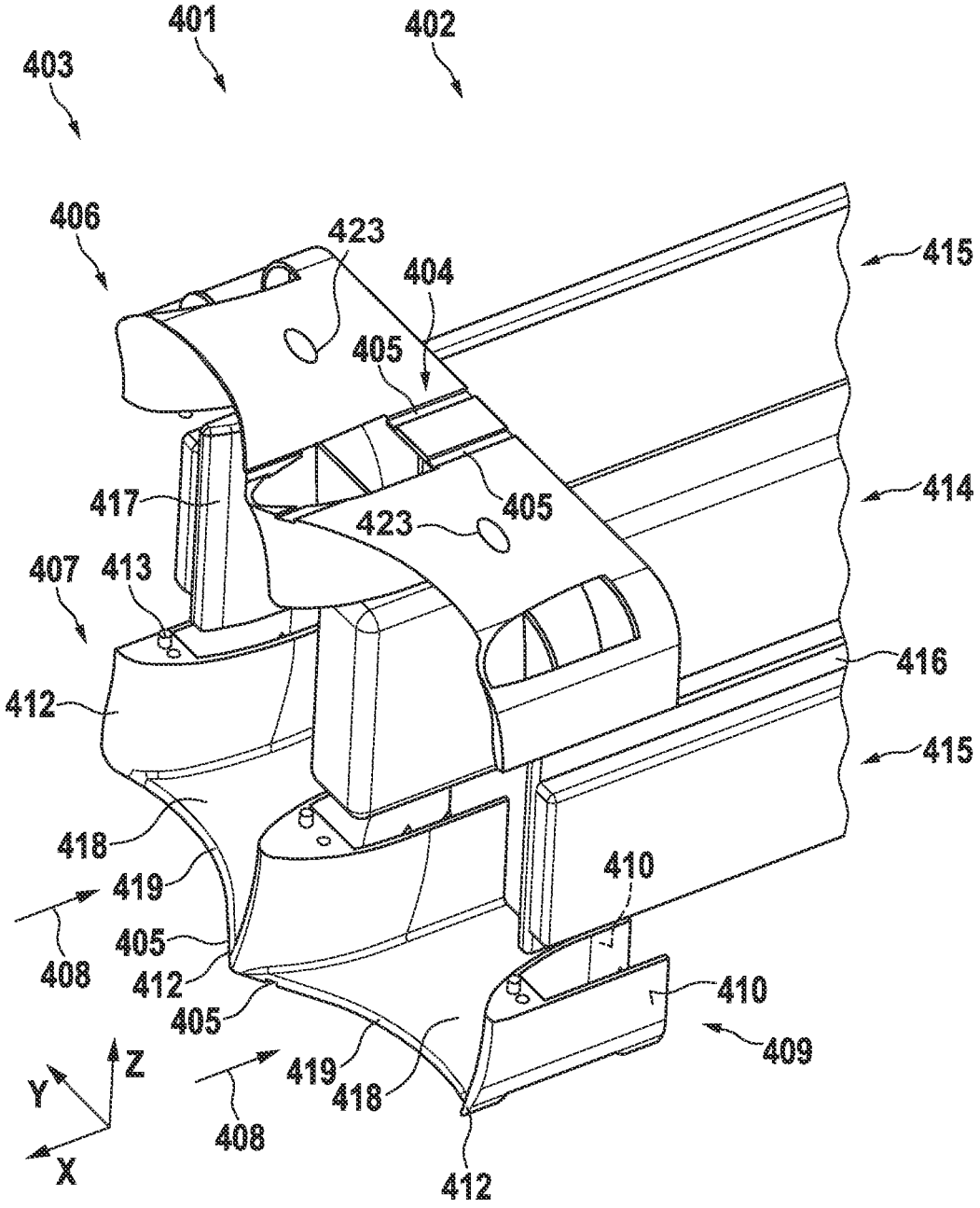
FIG. 2 is a perspective exploded view of a holding device according to the invention.

FIGS. 1 and 2 show an embodiment of the silencer 401 with two holding devices 403 arranged on the front side and three parallel damping elements 402 positioned therebetween and spaced apart in the transverse direction Y. The silencer extends essentially in a longitudinal direction X. Further, the silencer 401 has a transverse direction Y and a height direction Z. In operation, the silencer 401 is inserted into an air duct corresponding to its dimensions, wherein exhaust air to be discharged, in particular a fume extraction hood, flows through the silencer 401 in longitudinal direction X. For this purpose, the exhaust air flows into one of the holding devices 403, passes through the free spaces bounded by the damping elements 402 and flows out of the opposite holding device 403 again from the silencer 401. For adaptation to different air duct elements or locations of use within the exhaust air system, the damping elements 402 can be shortened to the desired length. Due to damping elements 402 being separated from each other, different insulation materials can be used within the silencer 401 at the same time in order to be able to individually adapt the silencing to installation specifications or special customer requirements. The holding devices 403 each comprise a half-shell-shaped upper part 406 and a half-shell-shaped lower part 407, wherein these have an outer contour in the assembled state which corresponds to the inner contour of a flat channel. Between the upper and lower parts 406, 407, two parallel air passages 408 are formed, through which air can flow in and out of the silencer in the longitudinal direction X. The air passages 408 are formed in the longitudinal direction X. Three, in particular evenly spaced webs 409 are formed between the upper and lower parts 406, 407, which are bounded laterally by air guide surfaces 410 and have damping element receptacles 420 at the rear. In the parting plane between the upper and lower parts 406, 407, the webs 409 each have surfaces facing one another, on which releasable connecting devices 413 are arranged in each case. As shown, the detachable connecting device has a latching pin and a latching hole arranged next to it for each surface. Since the upper part and the lower part are designed as identical parts, the latching pins engage in the respective opposite latching holes. On the front side, i.e. on the air inlet side, the central web 409 has a flow-optimized taper 412, at the tip of which the lateral air guide surfaces 410 meet. The lateral webs 409 also have tapers 412, whereby these have a tip which is formed from an air guide surface 410 facing the air passage 408, which meets the outer contour of the holding device 403 or the respective half shell 406, 407 on the front side. In the assembled state, the individual opposing web elements such as the air guide surfaces 410 are aligned with each other in the height direction Z. Above the central web 409, the holding device has a fastening device 404 for fastening the silencer in an air duct 421, which is implemented by L-shaped grooves formed in the outer contour of the holding device 403 with laterally projecting guide catches 405. The silencer 401 may have corresponding fastening devices 404 on its upper or lower side only, as well as on both its upper and lower sides. FIG. 2 also shows thickenings 423, which are arranged on the outer circumference of the holding device 403 and are realized as variously designed local material accumulations. The thickenings 423 serve to create a clamping connection between the air duct 421 and the holding device 403. Of course, in addition to the embodiment shown, further embodiments can be provided which have only one of the two fastening devices described above as the fastening device in each case, i.e. either L-shaped grooves with laterally projecting guide catches 405 or thickenings 423. In the embodiment with thickenings 423, it can furthermore be provided in particular that the air duct does not have its own fastening device. The damping elements 402 are made of different materials, wherein illustrated the middle silencer element 414 is made of a material different from that of the outer silencer elements 415. As can be seen on the rear holding device 403, the damping element receptacles 420 each have retaining prongs 411 aligned in the height direction Z, by means of which the respective damping element 402 can be fastened in the respective damping element receptacle 420. At the same time, openings to the respective silencer elements 414, 415 are provided on the outer circumference of the holding devices 403, through which these can be pressed out of or removed from the holding devices from the outside, for example if an damping element is to be replaced after a certain running time. In particular, it can be readily seen in FIG. 2 that the holding device 403 has concave indentations 419 distributed around its outer circumference at the front and set back in the longitudinal direction X, which indentations are arranged on the half-shell sections 418 extending substantially in the transverse direction Y and bounding the air inlets 408. Furthermore, it can be seen that likewise the webs 409 have a concave course at the front in the height direction Z, set back in the longitudinal direction X. These concave elements provided in two different planes have the particular advantage of optimizing the flow behavior of the incoming air. FIG. 2 further shows that the lateral silencer elements 415 have, in the region of their associated damping element receptacles 420, an outlet region 417 which widens the flow cross section and is adapted to the contour of the associated damping element receptacles 420. Also visible are lateral recesses 416 on the outer upper and lower sides of the lateral silencer elements 415.

Figure 3:
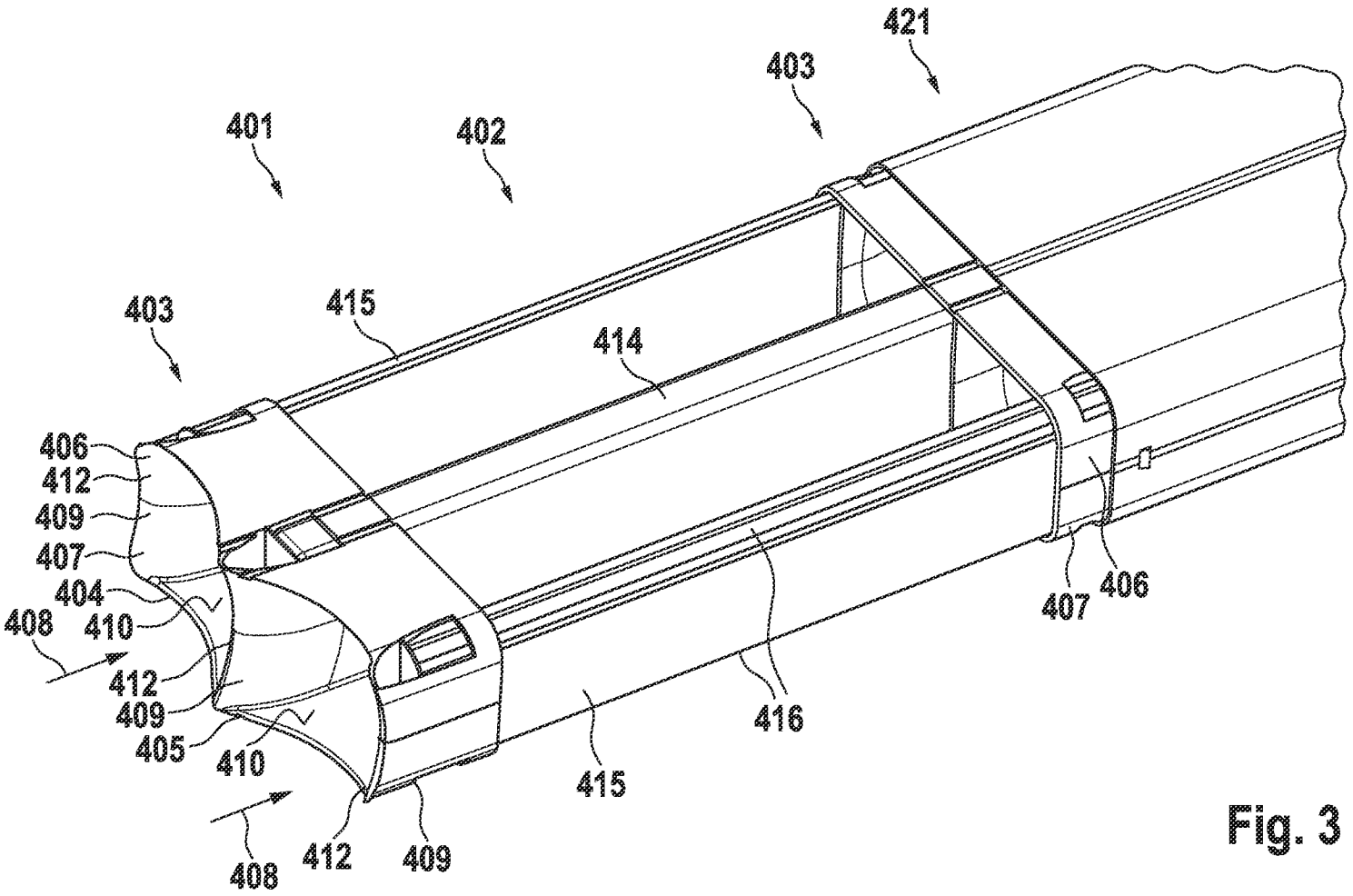
FIG. 3 is a perspective view of an assembly process of the silencer according to the invention.

FIG. 3 shows an assembled silencer 401 which is inserted into a flat duct 421 in longitudinal direction X for assembly. The attenuator elements 402 are fixed in the respective attenuator element receptacles 420 by being slipped onto the retaining prongs 411 and then upper and lower parts 406, 407 of the holding devices 403 are clipped together via the releasable connecting device 413. When assembled, the silencer elements 402 are completely shielded from the air guide surfaces 410 in the area of the air passages 408. Each air passage 408 is aligned with an opposite air passage 408 of the opposite holding device. Between them, the air flowing through is channeled laterally by insulating mats 414, 415 of different materials. To insert the silencer, the fastening device 404 is threaded into the complementary fastening device 422 of the flat channel 421 under a slight pretension, so that the silencer can be pushed to the desired position by means of slight pressure. The bias is selected so that the silencer 401 remains in the desired location even in a vertically oriented flat channel.

Figure 4:
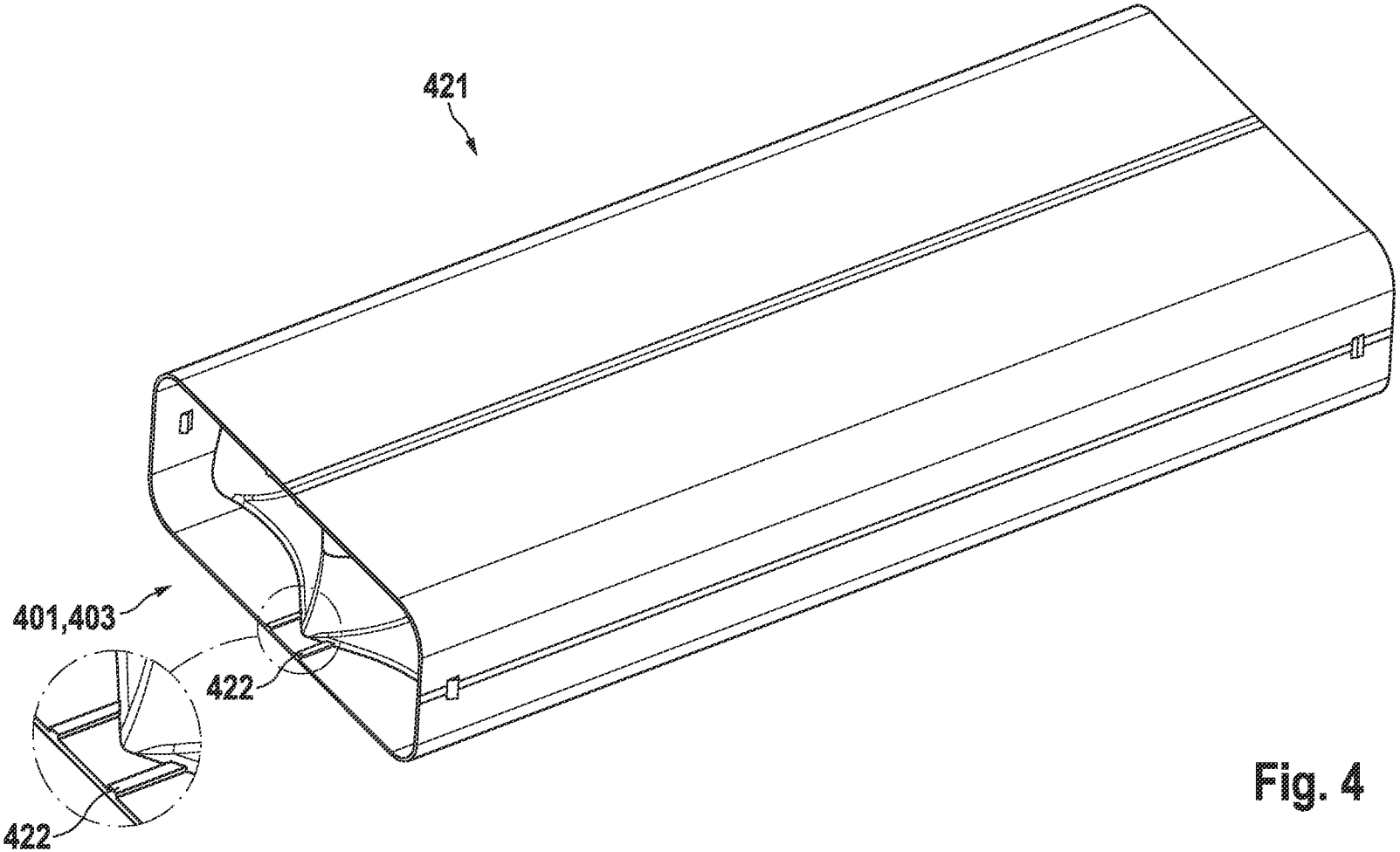
FIG. 4 is a perspective view of a silencer according to the invention received in an air duct.

Finally, FIG. 4 shows the final position of the silencer 401 in the flat duct 421, with the holding device 403 resting against the inner contour of the flat duct 421, thus providing the largest possible flow cross-section to minimize the flow resistance generated by the silencer.

The features of the invention disclosed in the foregoing description, in the drawings as well as in the claims may be essential to the realization of the invention both individually and in any combination.

The invention claimed is:

1. A silencer for installation in an air duct, in particular in a flat duct, comprising:

at least one sound-absorbing damping element extending essentially in a longitudinal direction (X) of the air duct, and having at least one holding device which accommodates the damping element at least in sections, wherein the holding device has a fastening device for fixing the silencer in the air duct, and wherein the holding device has two half-shells that are detachably connected to one another, in particular in a height direction (Z) of the silencer, and between which the damping element is received and fixed at least in sections.

2. The silencer of claim 1, which comprises at least two damping elements consisting of different sound-absorbing materials which are arranged to damp sound in different frequency ranges.

3. The silencer of claim 1, wherein the holding device has at least one, in particular spherical or lenticular, thickening arranged on its outer circumference for generating a defined clamping force between the silencer and the air duct.

4. The silencer of claim 1, wherein the fastening device comprises at least two undercut latching portions projecting in a transverse direction (Y) of the silencer.

5. The silencer of claim 4, wherein the undercut latching portions are part of at least one guide rail arranged in the longitudinal direction (X) on the outer periphery of the holding device.

6. The silencer of claim 1, wherein the outer contour of the interconnected half-shells corresponds to the flow cross-section of the air duct.

7. The silencer of claim 1, wherein the half-shells enclose at least one air passage oriented in the longitudinal direction (X).

8. The silencer of claim 1, wherein at least one web is formed between the interconnected half-shells, which web traverses the flow cross-section perpendicularly to the longitudinal direction (X) and has an open damping element receptacle facing the damping element in the longitudinal direction (X), in which receptacle the damping element is received at the end face.

9. The silencer of claim 8, wherein the damping element extends through the flow cross-section in the direction corresponding to the web perpendicular to the longitudinal direction (X).

10. The silencer of claim 8, wherein the web is disposed in the retainer so as to centrally divide the air passage.

11. The silencer of claim 8, wherein a retaining means for retaining the damping element is provided in the damping element receptacle.

12. The silencer of claim 11, wherein the retaining means comprises retaining prongs oriented transversely to the longitudinal direction (X), onto which the damping element is slipped.

13. The silencer (401) of claim 8, wherein the silencer receptacle (420) comprises air guide surfaces (410) surrounding the silencer element (402) in the longitudinal direction (X) and laterally shielding the silencer element (402) from the at least one air passage (408).

14. The silencer of claim 13, wherein the air guide surfaces meet on the side of the web facing away from the damping element, tapering the web in the longitudinal direction (X).

15. The silencer of claim 4, wherein the holding device comprises a plurality of parallel spaced apart webs in which a corresponding plurality of parallel spaced apart damping elements are received.

16. The silencer of claim 8, wherein the opposing end faces of the at least one damping element are held by two opposing holding devices, wherein the damping element receptacles of the holding devices are aligned facing each other.

17. An assembly of an air duct and a silencer according to claim 1, wherein the silencer is fixed in the air duct by means of the fastening device (404).

18. The assembly of claim 17, wherein the air duct includes fastening devices complementary to the fastening devices of the silencer.

* * * * *